US005848699A

United States Patent [19]

Pettersson

[11] Patent Number: 5,848,699

[45] Date of Patent: Dec. 15, 1998

[54] PACKAGE FOR FRAGILE GOODS

[75] Inventor: Allan Pettersson, Norrköping, Sweden

[73] Assignee: Munksjö Förpackningar AB, Norrköping., Sweden

[21] Appl. No.: 952,465

[22] PCT Filed: May 15, 1996

[86] PCT No.: PCT/SE96/00641

§ 371 Date: Nov. 17, 1997

§ 102(e) Date: Nov. 17, 1997

[87] PCT Pub. No.: WO96/36540

PCT Pub. Date: Nov. 21, 1996

[30] Foreign Application Priority Data

May 15, 1995 [SE] Sweden ..... 9501795

[51] Int. Cl.[6] ..... B65D 81/02

[52] U.S. Cl. ..... 206/521.1; 206/521.6; 229/114

[58] Field of Search ..... 206/521.1, 521.3, 206/521.6; 229/114, 120.21, 146

[56] References Cited

U.S. PATENT DOCUMENTS

| | | | |
|---|---|---|---|
| 1,580,366 | 4/1926 | Bergstein | 206/521.6 |
| 2,130,378 | 9/1938 | Bueschel . | |
| 2,900,119 | 8/1959 | Gross . | |
| 2,933,231 | 4/1960 | Colgren et al. | 206/521.6 |
| 5,718,370 | 2/1998 | Lafferty et al. | 229/114 |

FOREIGN PATENT DOCUMENTS

| | | |
|---|---|---|
| 1 517 90 | 1/1988 | Denmark . |
| 1 262 021 | 4/1960 | France . |
| 2 217 946 | 10/1973 | Germany . |
| 37 01 388 | 7/1988 | Germany . |

*Primary Examiner*—David T. Fidel
*Attorney, Agent, or Firm*—Browdy and Neimark

[57] ABSTRACT

The present invention relates to a packaging unit for storing and transporting goods, such as eggs or other fragile articles. The packaging unit comprises a bottom section (2) and a lid section (1) hinged thereto. The bottom section includes a flat bottom (15) and opposing side panels (17; 18) and an intermediate panel (16) spaced above the bottom (15). The intermediate panel (16) is hinged to a side panel (17; 18) and contains rows of openings (29) for receiving and supporting packaged goods. The lid section (1) includes a central panel (4) which forms the upper side of the lid section, and opposing side panels (5; 6). Each of the bottom section (2) and the lid section (1) has four side panels (17, 18; 5, 6) which oppose one another in pairs, wherein there is provided in each of the corners formed between mutually adjacent side panels in the bottom (2) and in the lid section (1) at least one foldable fastener tab (21; 9) which constitutes an extension of a side panel (17, 18; 5, 6) and which is folded-in and permanently fastened to a nearest adjacent side panel.

11 Claims, 5 Drawing Sheets

PACKAGE FOR FRAGILE GOODS

BACKGROUND OF THE INVENTION

The present invention relates to a packaging unit for storing and transporting fragile goods, such as eggs and other fragile articles. The packaging unit is comprised of a bottom section and a lid section hinged thereto. The bottom section includes a flat bottom and opposing side panels, and an intermediate section placed above the flat bottom. The intermediate section is hinged to a side panel and includes rows of openings which are intended to receive and support the packaged articles. The lid section includes a central panel which forms the upper side of the lid section, and opposing side panels. The invention also relates to a blank from which the packaging unit can be erected.

An example of known packaging units of the aforedescribed kind are egg cartons that comprise a lid and a bottom part that are both made of paper pulp that has been pressed to the desired shape. The drawback with packaging units of this nature is that the material used in their manufacture, i.e. paper pulp, cannot be recycled. A further drawback is that the packaging units are bulky due to their wall thickness and also due to the outwardly projecting edge that is located at the junction of the lid section with the bottom section.

It is also known to produce packaging units that are more space effective; see for instance U.S. Pat. No. 2,936,943. These packaging units have a bottom section and a lid section that are formed from a thinner material than in the aforesaid case, such as paper board for instance. Consequently, these packaging units are not able to withstand the loads and impact forces to which they are subjected during transportation. One drawback with this type of packaging unit is that they do not provide fragile goods with effective protection during transportation. Another drawback is that the packaging unit cannot be packed on standard transport pallets in a space effective fashion.

The object of the present invention is to provide a packaging unit which will overcome the aforesaid problems, and then particularly to an egg packaging unit of compact construction which is adapted for use with standard transport pallets and which will effectively protect the packaged goods despite its compact form, and which can be produced from a production friendly and recyclable material, such as corrugated (paper) board or solid board.

This object is achieved with a packaging unit and a packaging unit blank having the construction defined in the following claims.

The inventive packaging unit has a construction which enables compact packaging, by which is meant that a standard pallet measuring 1200×800 mm will accommodate 4×8 inventive packaging units on each stacked layer. The stable construction of the packaging unit with its glued end-wall sections and its glued closure means enables packaging units that contain fragile goods, such as eggs for instance, to be stacked one upon the other without damaging the goods. In addition to providing supports for the packaged goods, the end-walls of the packaging unit are also intended to prevent liquid from leaking from the packaging unit should the fragile goods contained therein become damaged.

According to one preferred embodiment of the invention, both the lid section and the bottom section have a slightly pyramidal shape, which enables packaging units that have been developed and erected to an intermediate state to be nested one within the other. In this way, the packaging units can be erected in a centrally located packaging unit erecting machine and thereafter stacked in their partially developed intermediate state for storage and transportation to smaller, local packing units that lack access to expensive erecting machine equipment. Consumers of the inventive packaging unit can therefore choose between investing in a packaging unit erecting machine and therewith use flat unit blanks as starting material, or can use erected packaging units according to an embodiment illustrated in FIG. 4.

According to another preferred embodiment of the invention, the openings punched out in the packaging unit material are provided with a lip which is pressed down in relation to the adjacent flat intermediate section. The openings are thereby given a goods adapted form while ensuring that the mechanical strength of the supportive parts between the openings does not fall beneath a critical level. The downwardly pressed lip around the respective openings thus stiffens the construction and therewith further contributes towards a compact and space-lean packaging unit.

The invention will now be described in more detail with reference to exemplifying embodiments thereof and also with reference to the accompanying drawings, in which

DESCRIPTION OF THE PREFERRED EMBODIMENTS

Figure 1:
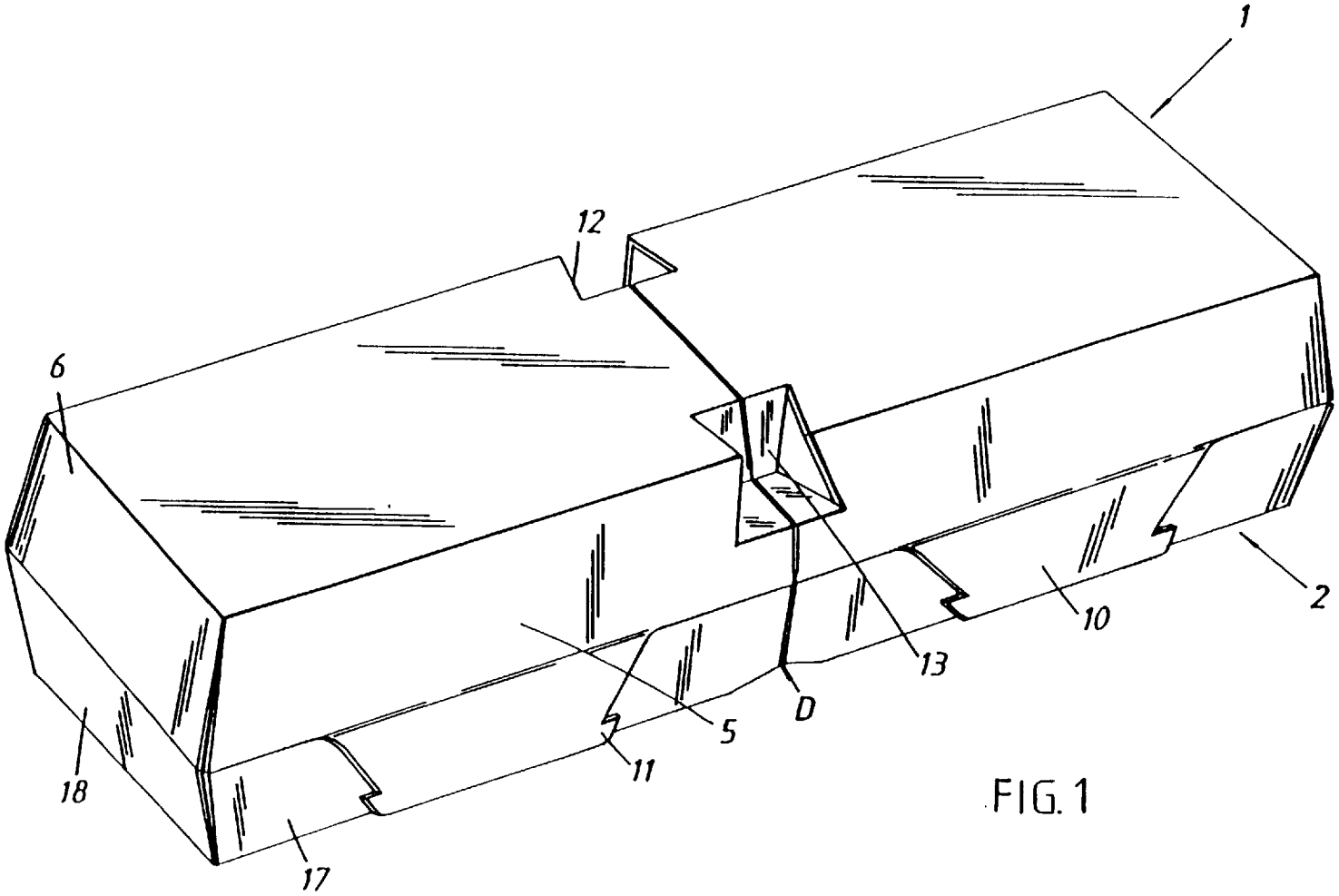
FIG. 1 is a perspective view of a closed packaging unit according to the invention.
Figure 2:
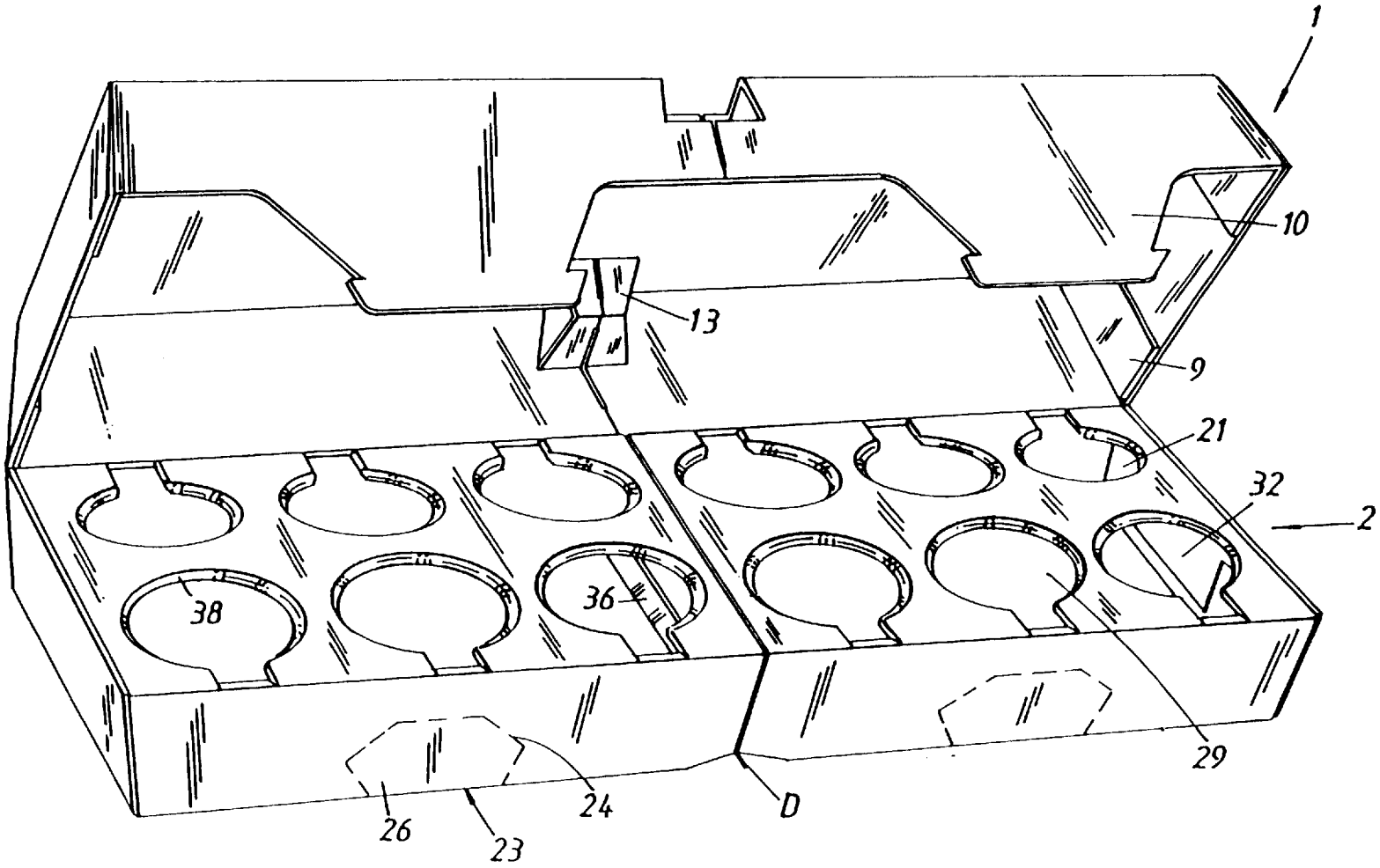
FIG. 2 is a perspective view of an inventive package unit in an open, goods packaging state.

The illustrated packaging unit comprises a lid section 1 and a bottom section 2, as shown in FIGS. 1 and 2. The lid section 1 and the bottom section 2 are formed as a unit which is produced from a single-piece blank, preferably made of paper board or corrugated paper board.

Figure 3:
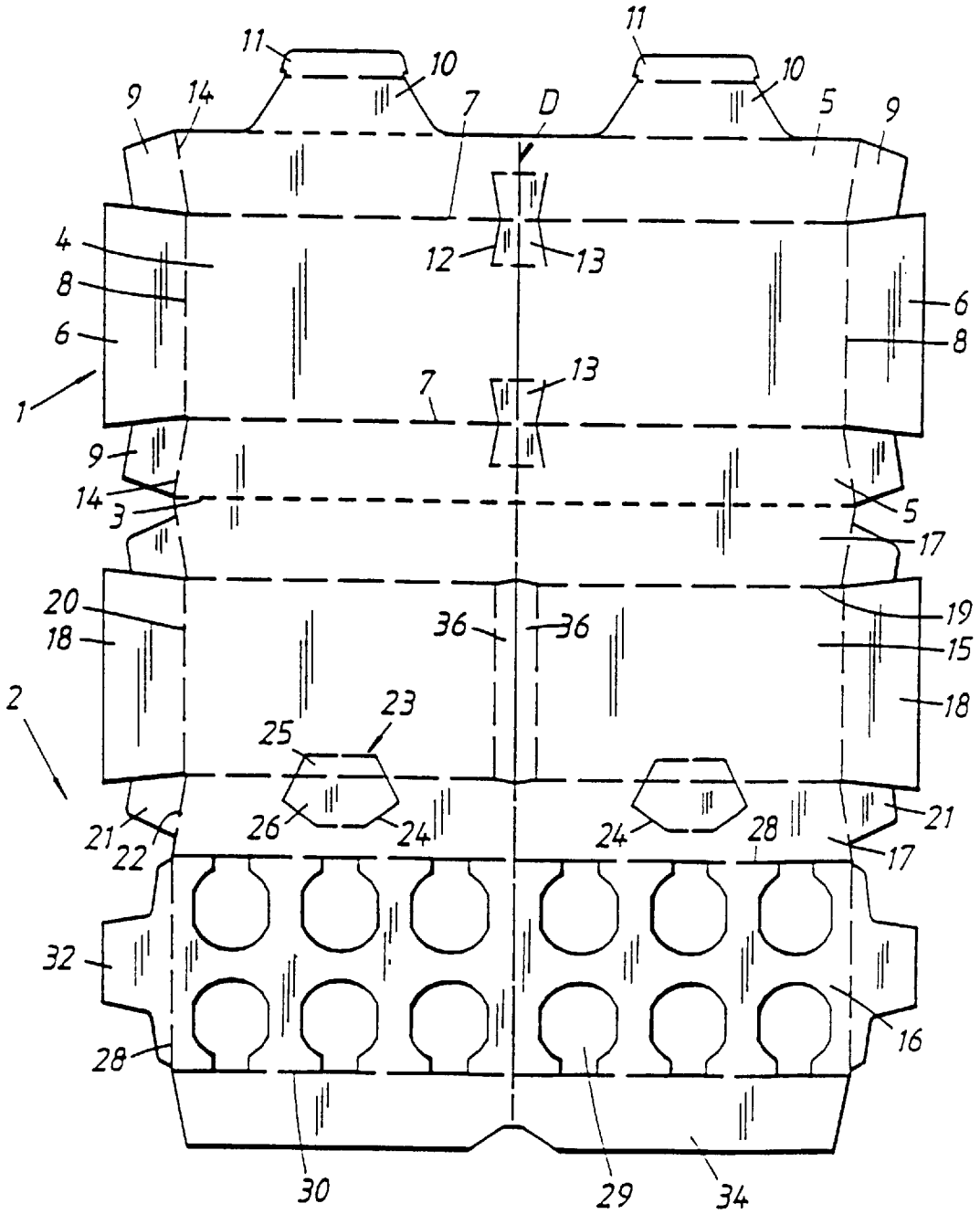
FIG. 3 illustrates a flat inventive blank from which the packaging unit of FIGS. 1–2 is constructed.
Figure 4:
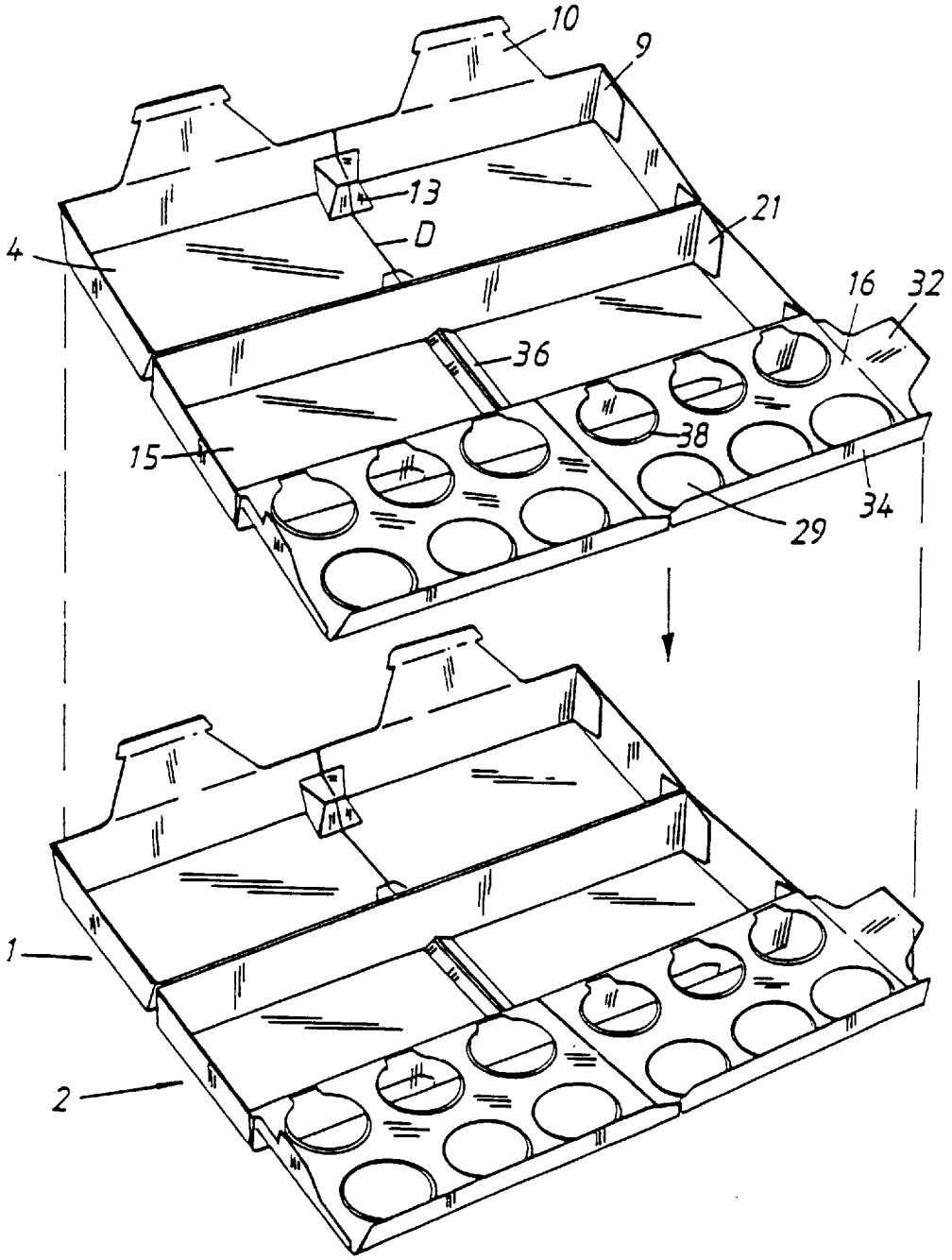
FIG. 4 is a perspective view of inventive packaging units in a partially erected intermediate stage in which the packaging units can be nested one within the other.

FIG. 3 illustrates the packaging unit blank which when erected forms the finished packaging unit shown in FIGS. 1 and 2. FIG. 4 shows an intermediate state in which the packaging unit has been erected partially in a packaging unit erecting machine but which has not yet been completely developed to the final goods-packaging state shown in FIG. 2. The packaging unit is thus brought to an intermediate state in which packaging units can be stacked or nested one within the other in a manner described in more detail below.

FIG. 3 shows the blank from which a packaging unit is erected and which includes a lid section 1 and an adjoining bottom section 2. The two sections are mutually separated by a fold line 3 around which the lid section can be swung when opening and closing the packaging unit. A perforated line D extending along the blank centre line divides the blank into two symmetrical parts.

The lid section 1 comprises a rectangular central panel 4, two long side panels 5 and two short side panels 6. The central panel 4 of the lid section is delimited with regard to the long and the short side panels by fold lines 7, 8. Two pairs of cut-outs 12 are provided centrally of the long side panels and extend laterally of respective fold lines 7 on both sides thereof. When the packaging unit is erected, the cut-outs 12 form support flaps 13 which can be folded in towards the packaging unit and which function to support the packaged goods laterally. The two long side panels 5 have a slightly trapezoidal shape and are extended at both outer ends with outwardly foldable and narrowing fastener tabs 9. The fastener tabs 9 adjoin respective long side panels 5 via fold lines 14 which are slightly oblique in relation to the fold lines 8 on the short side panels 6. The short side panels 6 are also slightly trapezoidal in shape and widen in the same way as the long side panels 5 in a direction away from the central panel 4. Arranged along the outer long side panel 5 are double fastener tongues 10. Each fastener tongue is provided at its outer end with fluke-like elements 11 that project out from both sides of said tongue.

The bottom section 2 comprises a generally rectangular bottom panel 15 and a generally rectangular intermediate panel 16. Upwardly foldable sealing flaps 36 are provided on each side of the perforated line D in the bottom panel 15. Two long side panels 17 and two short side panels 18 are delimited from the bottom panel 15 by respective fold lines 19 and 20. Both outer ends of the two long side panels 17 are extended with a respective outwardly narrowing fastener tab 21, which can be folded in the same way as in the lid section 1, along oblique fold lines 22 . The short and the long side panels 17, 18 are trapezoidal in shape with a width that increases in the outer edges as seen from the bottom panel 15. Lines of perforations 24 delimit two fastener tongues 23 having an extension on both sides of the fold line 19 which lies proximal to the intermediate panel 16 and which in the erected state of the packaging unit forms the bottom longitudinally extending corner of the bottom section 2 (see FIG. 2). That part of respective fastener tongues 23 which is located in the bottom panel 15 forms opening flaps 25, while that part of respective fastener tongues 23 which is located in the long side panel 17 forms locking flaps 26 for coaction with the locking tongues 10, as described in more detail below.

The intermediate panel 16 of the bottom section adjoins the long side panel 17 via a fold line 28. The intermediate panel 16 has punched therein double rows of openings 29 which are intended to receive and support goods (not shown). Fold lines 28, 30 delimit the intermediate panel 16 from short side flaps 32 and an outer flap 34 provided along the long side of the intermediate panel.

FIGS. 2 and 4 show an erected packaging unit in two different folding states. FIG. 4 shows a packaging unit in a partially erected, intermediate state in which it can be conveniently stacked or nested in similar partially developed units for storage and transportation purposes, whereas FIG. 2 shows the packaging unit in a fully developed or erected state in which it is able to receive goods for storage.

The size or diameter of the openings 29 punched in the blank (FIG. 3) is smaller than the size or diameter of the goods to be packaged. Prior to erecting the packaging unit in a packaging unit erecting machine, the blank is therefore subjected to a pressing operation in which the material of the intermediate panel 16 closest to respective openings 29 is pressed down, in a dry or moist state, to form a reinforcing edge 38 that extends around the opening 29 (see FIG. 2). This downward pressing of the material around the opening widens the opening 29 to a size suitable to accommodate the goods to be packaged and the reinforcing edge 38 thus formed enhances the supporting capacity of the intermediate panel 16. The construction can be further reinforced, by pressing down the two edges along the perforated centre line D in the intermediate panel 16 in the same pressing operation, so as to form two reinforcing edges centrally in the intermediate panel 16 (these edges not being shown in the Figures).

When erecting the blank shown in FIG. 3, the lid section 1 is folded along its fold lines 7, 8, 14 and the fastener tabs 9 are fastened to the inside of the short side panels 6 in some suitable way, for instance glued thereto. The bottom section 2 is folded along its fold lines 19, 20, 22 and the fastener tabs 21 are fastened to the inside of the short side panels 18 in a similar suitable way. The intermediate panel 16 is either folded in over the bottom panel 15 when the packaging unit is to be fully erected, or is only partially erected (see FIG. 4) to a state in which the thus partially developed or erected packaging unit can be stacked or nested in similarly partially erected units for storage and transportation. As a result of the pyramidal shape of the erected lid and bottom sections 1, 2, the packaging units can be nested in one another when the intermediate panel 16 is developed. Thus, when in their intermediate state, shown in FIG. 4, the packaging units can be stored and transported in a space-lean fashion.

The partially erected packaging unit can be brought to a finished, fully erected packaging state (shown in FIG. 2), by folding-in the short side flaps 32 and the outer long side flaps 34 inwardly of the short side flaps 18 and the long side flaps 17 respectively. The short side flaps 32 are configured for accommodation between the fastener flaps 21. The short side flaps 32 and the long side flaps 34 support the intermediate panel 16, through their abutment with the bottom panel 15, while, at the same time, further stiffening the construction so as to enable the external measurements of the packaging unit to be kept down.

After placing the goods, e.g. the eggs, into the openings 29 in the bottom section 2, the packaging unit is closed as shown in FIG. 1. The packaging unit is closed by fastening, preferably gluing, the two locking tongues 10 in the locking flaps 26 on the fastener tongues 23 of the bottom section. As will be seen from FIG. 1, the goods are fully enclosed in the closed packaging unit, which is also sealed so as to prevent unintentional opening of the packaging unit. As a result of this design, the person who finally opens the packaging unit can be sure that no unauthorized person has accessed the packaged goods. The glued closure means also enhances the mechanical strength of the packaging unit and strengthens its resistance to pressure exerted on the top of the unit.

The support flaps 13 in the lid section 1 of the packaging unit are pushed in towards the bottom section 2 and function to support the goods, i.e. the eggs, laterally. The sealing flaps 36 in the bottom panel 15 are also folded up to form supports for the packaged goods. The packaging unit is also designed to enable it to be divided into two equal, smaller units along the perforated line D, suitably when it reaches the final user. In this state, the outwardly folded sealing flaps 36 also function to prevent leakage from the packaging unit should the packaged goods be damaged.

The packaging unit is opened by pressing-in the opening flap 25 on the tongue 23 in the bottom panel 15 with a simple hand movement, such as to loosen this part of the tongue along the perforations 24. There is thereby formed in the packaging unit an opening which serves as a finger grip in releasing the remaining part of the tongue 23, i.e. the locking flap 26, from the packaging unit. The packaging unit is thus easy to open with a simple grip of the hand, which also makes the packaging unit friendly to handicapped persons. The packaging unit is reclosed by inserting the fluke-like elements 11 on the locking tongues 10 into those openings that are formed in the bottom section 2 by loosening the fastener tongues 23 therefrom, thereby enabling the lid section 1 of said unit to be kept closed.

Figure 5:
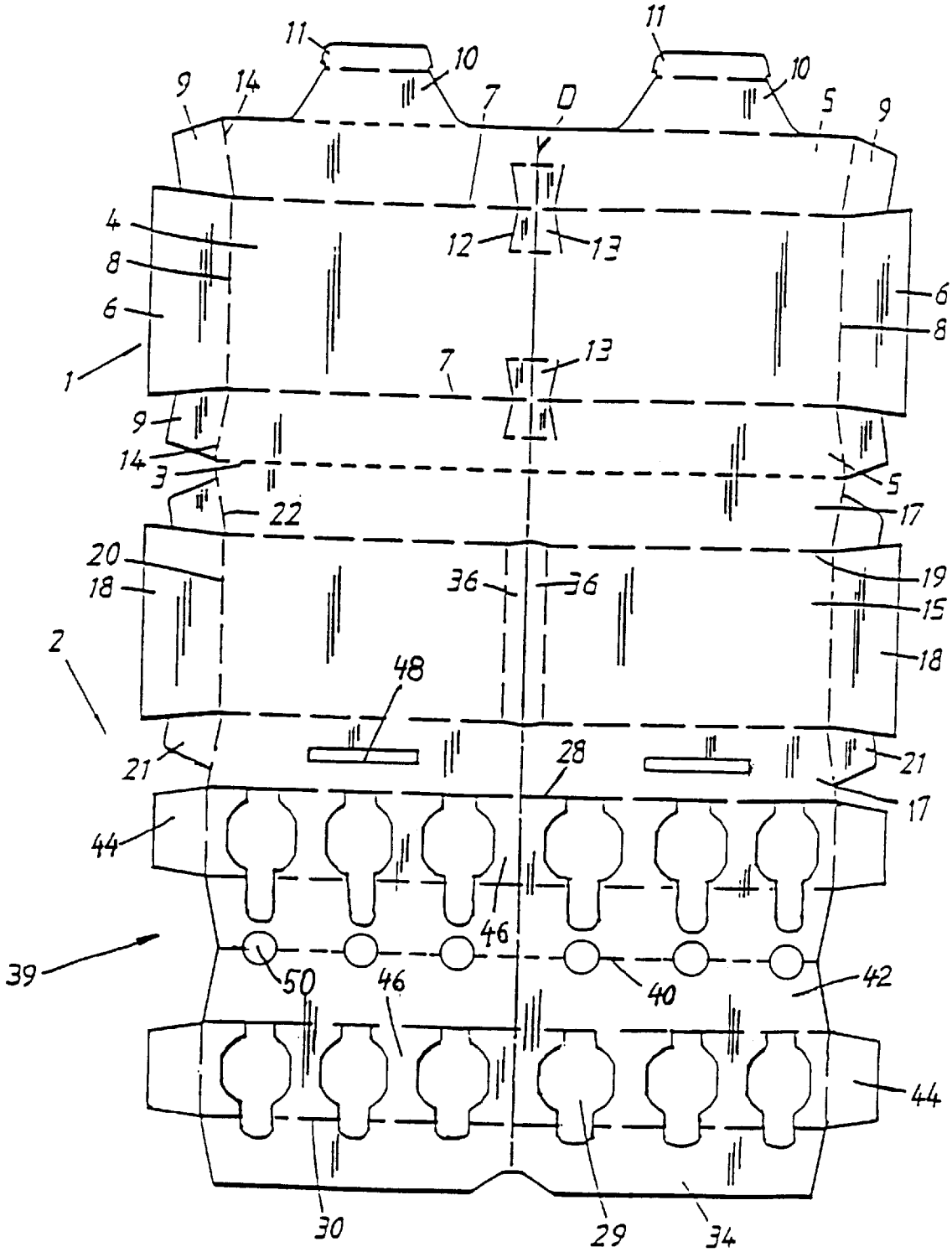
FIG. 5 illustrates a flat packaging unit blank according to a second embodiment of the invention.

FIG. 5 illustrates a second embodiment of an inventive blank. The lid section 1 of the packaging unit is formed in the blank in the same way as that described with reference to FIG. 3, whereas the intermediate panel 39 of the bottom section having goods-receiving openings 29 punched therein has a different construction.

The intermediate panel 39 of this construction has provided between the two rows of punched-out openings 29 an intermediate part 42 which can be folded double and which is located at a perforated fold line 40. In this embodiment, the short side panels of the intermediate panel are formed as double flaps 44 on each side of the intermediate panel, said flaps forming trapezoidal extensions of the opening-containing panel 46. When the packaging unit is erected and closed, the intermediate part 42 forms a double, vertical supportive wall between the opening-containing panel 46 and the central panel 4 of the lid section, thereby further enhancing the resistance of the packaging unit to external forces.

The openings 29 in the panel 46 have been extended laterally, to provide further space for the goods in a lateral direction. At each pair of goods-receiving openings 29 there is provided along the fold line 40 a circular hole 50 which, when the packaging unit is erected, forms a semi-circular recess in the upper edge of the double-folded intermediate part 42. These recesses, or grooves, provide space for accommodating gripping arms which grip around the goods when packaging the goods in the erected packaging unit.

In this embodiment, the fastener tongues 23 have been replaced with elongated locking openings 48 into which the locking tongues 10 can be inserted an retained for re-closing the packaging unit.

When erecting the blank shown in FIG. 5, the lid section 1 is folded and secured in the same way as the lid section of the blank shown in FIG. 3. The bottom section 2 is then folded along its fold lines 19, 20, 22 and the fastener tabs 21 fasten to the inside of the short side planets 18. The intermediate panel 39 is then folded in over the bottom panel 15 and the two parts of the intermediate portion 42 are folded and fastened against one another. The long side flap 34 is then folded in and fastened to the inside of the long side flap 17 and the double flaps 44 are folded in at the same time, and fastened to the outside of the short side flaps 18.

After having placed the goods in respective recesses 29 in the erected packaging unit, the packaging unit is closed and sealed by fastening the two locking tongues 10 to the outside of the long side flap 17, for instance with the aid of a releasable adhesive. Once the glue seal has been broken, the packaging unit can be re-closed by inserting the fluke-like parts 11 of the locking tongues into respective locking openings 48.

When the packaging unit is closed, the edge part 40 of the intermediate part 42 that extends vertically in relation to the opening-containing panel 46 lies against the central panel of the lid section and therewith absorbs pressure forces acting against the lid section 1, which might otherwise cause damage to the packaged goods.

When needing to be able to stack, store and/or transport the packaging units in a partially erected or developed state shown in FIG. 4, the intermediate section 39 can be left in its developed state so as to enable the packaging units to be nested in one another. The packaging unit is fully erected by folding the portions of the intermediate part 42 towards one another, whereafter the intermediate section 39 is folded in over the bottom section and the long side flap 34 and the flaps 44 are folded-in inwardly of the long side flap 17 and the short side flaps 18 respectively. In this case, the parts of the intermediate section 39 are not fastened to one another or to the bottom section, but are allowed to lie loosely against one another.

It will be understood that the invention is not restricted to the aforedescribed and illustrated exemplifying embodiments thereof and that changes can be made within the scope of the following claims. For instance, the fastener tabs 9, 21 may instead form extensions of the short side panels 6, 18 or, alternately, of the short and long side panels. The locking tongues 10 may alternatively be provided on other free edges of the short or long side panels, both on the bottom section 2 and/or on the lid section 1, in which case the fastener tongues 23 will be disposed on corresponding parts of the lid or bottom section. The packaging unit may also have shapes other than the illustrated rectangular shape and the perforated line D may be excluded, in which case the unit cannot be divided. Instead of having a slightly pyramidal shape, the bottom and lid sections of the packaging unit may have the shape of a right-angled parallelepiped, therewith providing a parallelepipedic packaging unit.

I claim:

1. A packaging unit for transporting and storing goods, such as eggs or other fragile articles, comprising a bottom section (2) and a lid section (1) hinged thereon, said bottom section (2) including a planar bottom panel (15) and mutually opposing side panels (17; 18) and an intermediate panel (16), which is spaced above the bottom and is hinged to a side panel (17; 18) and contains rows of openings (29) for receiving and supporting the goods, and said lid section (1) including a central panel (4) which forms the upper side of the lid section, and mutually opposing side panels (5; 6), characterized in that each of said bottom section (2) and lid section (1) has at least four side panels (17, 18; 5, 6) which oppose each other in pairs, and that located in each of the corners formed between mutually adjacent side panels in the bottom section (2) and in the lid section (1) is at least one foldable fastener tab (21; 9) which constitutes an extension of a side panel (17, 18; 5, 6) and which is folded inwardly and fastened permanently to a nearest adjacent side panel.

2. A packaging unit according to claim 1, characterized in that a free edge of at least one of the side panels (5, 6, 18) of the lid section (1) or the bottom section (2) includes an outwardly projecting locking tongue (10) which is intended to be fastened either permanently or releasably to opposing side panels (6, 17, 18) of the bottom section (2) or the lid section (1) such as to thereby seal the packaging unit.

3. A packaging unit according to claim 2, characterized in that the locking tongue (10) is intended to be fastened to a fastener tab (23) in the side panel (6, 17, 18), said fastener tab (23) being delimited by a tearable perforation.

4. A packaging unit according to claim 3, characterized in that the fastener tab (23) is comprised of an opening flap (25) provided in the bottom panel (15) or in the central panel (4) and a locking flap (26) provided in the side panel (6, 17, 18).

5. A packaging unit according to claim 1, characterized in that the intermediate panel (16) of the bottom section (2) has at least one side panel (32, 34) which abuts the inside of the side panel (17, 18) of the bottom section (2) and supports against the bottom (15) of said bottom section.

6. A packaging unit according to claim 1, characterized in that the intermediate panel (16) of the bottom section (2) has at least one side panel (44) which abuts with and is fastened to the outside of the side panel (17, 18) of said bottom section (2).

7. A packaging unit according to claim 5, characterized in that the intermediate panel (39) of the bottom section (2) has a vertically directed intermediate part (42) having an edge part (40) which lies in abutment with the central panel (4) of the lid section when the packaging unit is closed.

8. A packaging unit according to claim 1, characterized in that the side panels (17, 18; 5, 6) of the bottom section (2) and the lid section (1) are inclined to the bottom panel (15) and the central panel (4) respectively at an angle greater than 90°.

9. A packaging unit according to claim 1, characterized in that each opening (29) in the intermediate panel (16) has a down-pressed reinforcement edge (38) extending around said each opening.

10. A packaging unit according to claim 1, characterized in that said unit is constructed from a flap one-piece paper board blank, preferably a corrugated paper board blank.

11. A flat paper board blank, preferably a flat corrugated paper board blank, which when erected forms a packaging unit according to claim 1.

* * * * *

UNITED STATES PATENT AND TRADEMARK OFFICE

CERTIFICATE OF CORRECTION

PATENT NO. : 5,848,699
DATED : Dec. 15, 1998
INVENTOR(S) : Allan Pettersson

It is certified that error appears in the above-identified patent and that said Letters Patent is hereby corrected as shown below:

Title page, after the last line, [57]"ABSTRACT", delete "11 Claims, 5 Drawing Sheets" and and insert –10 Claims, 5 Drawing Sheets--

Column 6, line 20, delete claims 1-11 and insert the following:

1. A packaging unit for transporting and storing goods, such as eggs or other fragile articles, said packaging unit being made of a one-piece paper board blank, preferably a corrugated paper board blank, and comprising a bottom section (2) and a lid section (1) hinged thereon, said bottom section (2) including a planar bottom panel (15) and hinged to the bottom panel, mutually opposing side panels (17; 18) and an intermediate panel (16), which is spaced above the bottom and is hinged to a side panel (17; 18) of the bottom section (2) and contains rows of openings (29) for receiving and supporting the goods, characterized in that said lid section (1) includs a central panel (4) which forms an upper side of the lid section, and hinged to the sides of the central panel (4), mutually opposing side panels (5; 6), that each of said bottom section (2) and lid section (1) has at least four side panels (17, 18; 5, 6) which oppose each other in pairs, that located in each of the corners formed between mutually adjacent side panels in the bottom section (2) and in the lid section (1) is at least one foldable fastener tab (21; 9) that constitutes an extension of the side panel (17, 18; 5, 6), that each fastener tab (21; 9) is folded inwardly and fastened permanently to a nearest adjacent side panel, and that the free edges of the side panels (5; 6) of the lid

UNITED STATES PATENT AND TRADEMARK OFFICE

CERTIFICATE OF CORRECTION

PATENT NO. : 5,848,699
DATED : Dec. 15, 1998
INVENTOR(S) : Allan Pettersson

It is certified that error appears in the above-identified patent and that said Letters Patent is hereby corrected as shown below:

section (1) lie in abutment with and supports against the free edges of the side panels (17; 18) of the bottom section (2) when the packaging unit is closed.

2. A packaging unit according to Claim 1, characterized in that a free edge of at least one of the side panels (5, 6, 18) of the lid section (1) or the bottom section (2) includes an outwardly projecting locking tongue (10) which is intended to be fastened either permanently or releasably to opposing side panels (6, 17, 18) of the bottom section (2) or the lid section (1) such as to thereby seal the packaging unit.

3. A packaging unit according to Claim 2, characterized in that the locking tongue (10) is intended to be fastened to a fastener tab (23) in the side panel (6, 17, 18), said fastener tab (23) being delimited by a tearable perforation.

4. A packaging unit according to Claim 3, characterized in that the fastener tab (23) is comprised of an opening flap (25) provided in the bottom panel (15) or in the central panel (4) and a locking flap (26) provided in the side panel (6, 17, 18).

5. A packaging unit according to any one of Claims 1-4, characterized in that the intermediate panel (16) of the bottom section (2) has at least one side panel (32, 34) which abuts the inside of the side panel (17, 18) of the bottom section (2) and supports against the bottom (15) of said bottom section.

UNITED STATES PATENT AND TRADEMARK OFFICE

CERTIFICATE OF CORRECTION

PATENT NO. : 5,848,699
DATED : Dec. 15, 1998
INVENTOR(S) : Allan Pettersson

It is certified that error appears in the above-identified patent and that said Letters Patent is hereby corrected as shown below:

6. A packaging unit according to any one of Claims 1-7, characterized in that the intermediate panel (16) of the bottom section (2) has at least one side panel (44) which abuts with and is fastened to the outside of the side panel (17, 18) of said bottom section (2).

7. A packaging unit according to Claim 5 or 6, characterized in that the intermediate panel (39) of the bottom section (2) has a vertically directed intermediate part (42) having an edge part (40) which lies in abutment with the central panel (4) of the lid section when the packaging unit is closed.

8. A packaging unit according to any one of Claims 1-7, characterized in that the side panels (17, 18; 5, 6) of the bottom section (2) and the lid section (1) are inclined to the bottom panel (15) and the central panel (4) respectively at an angle greater than 90°.

9. A packaging unit according to any one of Claims 1-8, characterized in that each opening (29) in the intermediate panel (16) has a down-pressed reinforcement edge (38) extending around said each opening.

UNITED STATES PATENT AND TRADEMARK OFFICE

CERTIFICATE OF CORRECTION

PATENT NO. : 5,848,699
DATED : Dec. 15, 1998
INVENTOR(S) : Allan Pettersson

It is certified that error appears in the above-identified patent and that said Letters Patent is hereby corrected as shown below:

10. A flat paper board blank, preferably a flat corrugated paper board blank, which when erected forms a packaging unit according to any one of Claims 1-9.

Signed and Sealed this

Third Day of August, 1999

*Attest:*

Q. TODD DICKINSON

*Attesting Officer*

*Acting Commissioner of Patents and Trademarks*